United States Patent [19]

Daudi et al.

[11] 4,354,407

[45] Oct. 19, 1982

[54] METHOD OF WHEEL MANUFACTURE FOR CORRECTING ROTATIONAL NON-UNIFORMITY OF A PNEUMATIC TIRE AND WHEEL ASSEMBLY AND APPARATUS FOR PERFORMING SUCH METHOD

[75] Inventors: Anwar Daudi, East Lansing; John H. Golata, Lansing; Doarde G. Triponi, East Lansing, all of Mich.

[73] Assignee: Motor Wheel Corporation, Lansing, Mich.

[21] Appl. No.: 234,651

[22] Filed: Feb. 17, 1981

Related U.S. Application Data

[62] Division of Ser. No. 104,319, Dec. 17, 1979, Pat. No. 4,279,287.

[51] Int. Cl.[3] ..... B26F 1/02

[52] U.S. Cl. ..... 83/55; 29/159 R; 29/159.01; 83/452; 83/620; 83/926 R; 301/5 B

[58] Field of Search ..... 83/55, 452, 926 R, 620, 83/622; 29/159 R, 159.01, 407; 152/375; 301/5 B, 1

[56] References Cited

U.S. PATENT DOCUMENTS

| | | |
|---|---|---|
| 276,292 | 4/1883 | Seymour . |
| 1,479,482 | 1/1924 | Prescott et al. . |
| 1,860,216 | 5/1932 | Ash . |
| 2,708,119 | 5/1955 | Best . |
| 3,046,058 | 7/1962 | Hamer . |
| 3,207,557 | 9/1965 | Hunter . |
| 3,461,710 | 8/1969 | Luedi et al. . |
| 3,581,550 | 6/1971 | Waterbury . |
| 3,808,660 | 5/1974 | Wik . |
| 3,951,563 | 4/1976 | Ravenhall . |

FOREIGN PATENT DOCUMENTS

| | | |
|---|---|---|
| 855956 | 11/1952 | Fed. Rep. of Germany . |
| 577826 | 6/1946 | United Kingdom . |
| 199821 | 10/1967 | U.S.S.R. . |

OTHER PUBLICATIONS

Main, "Design and Measurement of Truer Running Wheels", Society of Automotive Engineers, 1968.

*Primary Examiner*—Frank T. Yost

*Attorney, Agent, or Firm*—Barnes, Kisselle, Raisch & Choate

[57] ABSTRACT

A method of punching a wheel for a pneumatic tire and wheel assembly manufactured with mounting holes offset from the geometric center to locate the low point of the first harmonic of radial runout adjacent a given angular location, such as the valve hole, so that, when a tire is mounted thereon with the high point of the first harmonic of radial force variation aligned with the valve hole, the respective harmonics cancel each other to provide a tire and wheel assembly with enhanced rotational characteristics. In an apparatus for forming the wheel mounting holes by axially reciprocating a piercing tool against a wheel disc while the bead seats are clamped between wheel locating jaws, axially opposed jaw pairs are centered on an axis offset from the axis of reciprocation such that the centerline of the mounting holes is correspondingly eccentrically offset from the average bead seat axis.

4 Claims, 3 Drawing Figures

METHOD OF WHEEL MANUFACTURE FOR CORRECTING ROTATIONAL NON-UNIFORMITY OF A PNEUMATIC TIRE AND WHEEL ASSEMBLY AND APPARATUS FOR PERFORMING SUCH METHOD

This is a division of application Ser. No. 104,319, filed Dec. 17, 1979 entitled Method for Correcting Rotational Non-Uniformity of a Pneumatic Tire and Wheel Assembly and Apparatus for Performing such Method, now U.S. Pat. No. 4,279,287.

The present invention relates to methods and apparatus for wheel manufacture, and more particularly to correction of radial run out and radial force variations in a pneumatic tire and wheel assembly.

A problem long standing in the art lies in the production of pneumatic tires and wheels which, when assembled, will run true about their axis of rotation. Forces generated by any circumferential variation in the tire carcass or out-of-round conditions in the tire or wheel cause vibrations which, in turn, lead to dissatisfied customers and significant warranty claims against automobile manufacturers. The present trend among manufacturers toward higher tire inflation pressures and smaller vehicles to improve fuel economy accentuates the problem, so that uniformity in radial run out and force variation of the tire and wheel assembly has become more critical than in the past.

The state-of-the-art of wheel manufacture is such that wheels may now be produced with little variation in tire bead seat radius or radial run out. This has been accomplished by piercing the bolt mounting and center-pilot holes or openings in the wheel disc after the wheel disc and rim have been assembled and while the rim bead seats are clamped in fixed position coaxial with the piercing tool. However, tire manufacturers are not able to mass produce pneumatic tires of corresponding uniformity. Rather, production tires continue to exhibit substantial variation in radial force under dynamic conditions due to varying elasticity and thickness of the tire carcass, etc.

Recently, some auto manufacturers have begun spin- or dynamic-testing of each tire and wheel, determining the high and/or low points of the first harmonic of radial variation for the tire and the high and/or low points of the first harmonic of the average radial run out for the wheel, and then mounting the tire on the wheel so that the respective harmonics tend to cancel. This operation, termed "match mounting", manifestly is time consuming and expensive. Auto manufacturers have proposed that tire manufacturers dynamically test each tire and mark the tire carcass, such as on a side wall, at the location of the high (or low) point of the first harmonic of radial force variation. The problem remains, however, of matching tires so marked to the truer running wheels.

One object of the present invention is to provide a method of wheel manufacture and an apparatus for performing such method which will locate the low or high point of the first harmonic of bead-seat radial run out at a predetermined identifiable angular location on the wheel, and thereby eliminate the requirement in the "match mounting" technique previously discussed of testing each wheel individually. Another object of the invention is to tailor the amount of radial run out so located to a preselected nominal value which will substantially cancel the first harmonic of radial force variation in a production tire mounted wheel. A further object of the invention is to provide a method and apparatus for wheel manufacture which reduces the amount of eccentricity between the axis of the wheel center hole and the axis of the bolt circle.

Briefly described, the foregoing and other objects of the invention are accomplished by intentionally forming the bolt mounting and/or center-pilot openings in the wheel disc on an axis which is eccentrically offset from the average bead seat axis in a direction and by an amount predetermined to locate the low or high point of the first harmonic of bead seat radial run out circumferentially adjacent a selected location in the wheel rim. In a preferred embodiment, the low point of the first harmonic of radial run out lies substantially within a quadrant centered about the valve hole in the rim. A tire having the location of the high point of the first harmonic of radial force variation marked thereon may then be assembled onto the wheel in accordance with the invention such that the respective tire and wheel harmonics are complementary and thereby tend to cancel each other.

Presently preferred embodiments of the invention, together with additional objects, features and advantages thereof, are set forth in the following description and illustrated in the accompanying drawings in which.

Figure 1:
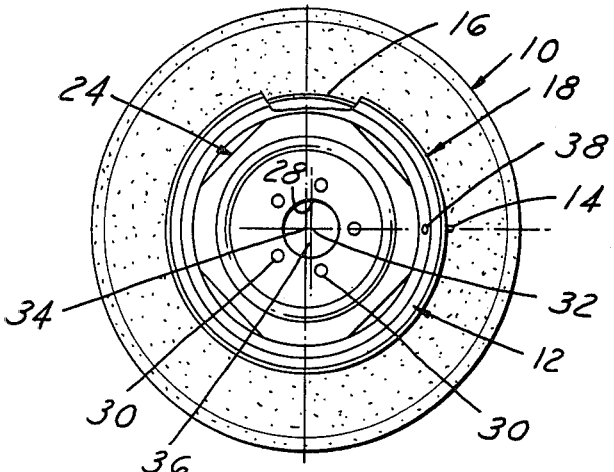
FIG. 1 is an elevational view of a pneumatic tire and wheel assembly constructed in accordance with the invention.

Referring to FIG. 1, a pneumatic tire 10 is pretested, i.e. prior to assembly onto wheel 12, for variations in radial force under dynamic operating conditions. Such testing may be accomplished by a tire manufactuer as previously described by mounting and inflating the tire on a test wheel structure, rotating the inflated tire against a load wheel, and measuring the amount and loci of the variation of radial force exerted by the tire. The circumferential location of a peak of the first harmonic of radial force variation, i.e. either the high or low point, is then identified by using conventional Fourier analysis techniques, and this location is marked as at 14 in FIG. 1 on the tire side wall near the tire bead 16. For the purpose of further discussion, it will be assumed that indicia 14 locates the high point of the first harmonic of radial force variation.

Wheel 12 includes a wheel rim 18 having the usual axially spaced bead seats 20,22 (FIG. 2) and a disc 24 carried internally of rim 18 for mounting the wheel to a vehicle. Disc 24 and rim 18 are separately manufactured to desired contour and then assembled to each other, with the disc 24 being permanently attached to the rim 18 as by press fit and welding or other joining methods. The particular rim and disc contours shown in the drawings are for illustrative purposes only and do not form part of the invention.

Figure 2:
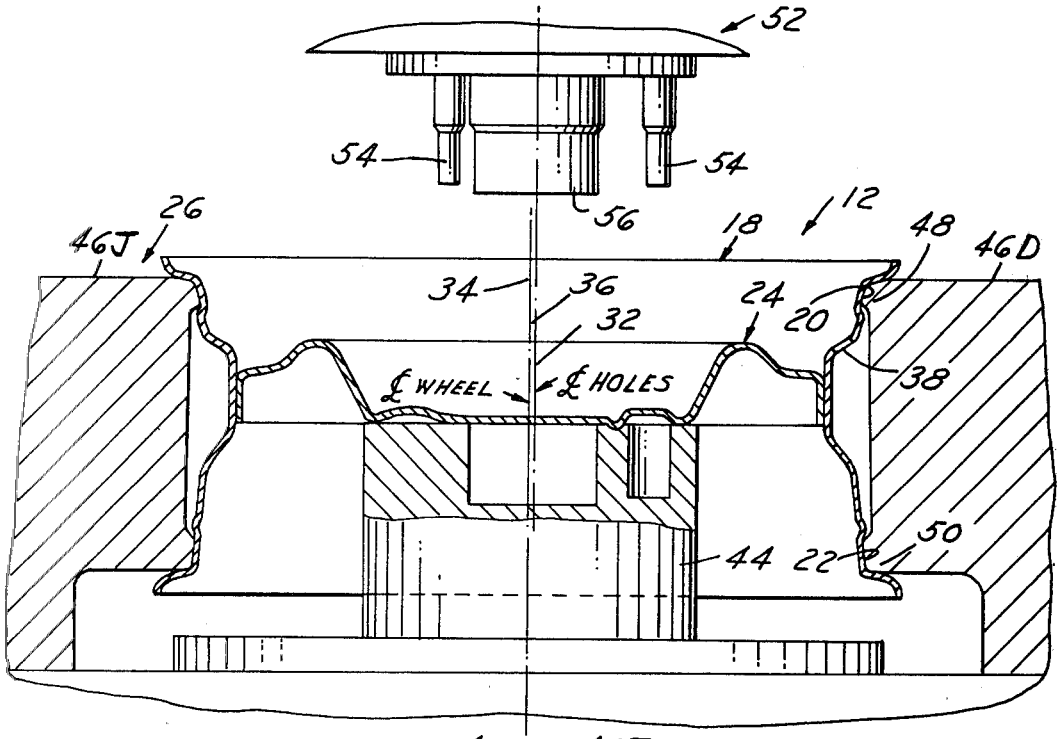
FIG. 2 is a side sectional view illustrating fabrication of the wheel in FIG. 1, and is generally taken along the line 2—2 in FIG. 3.
Figure 3:
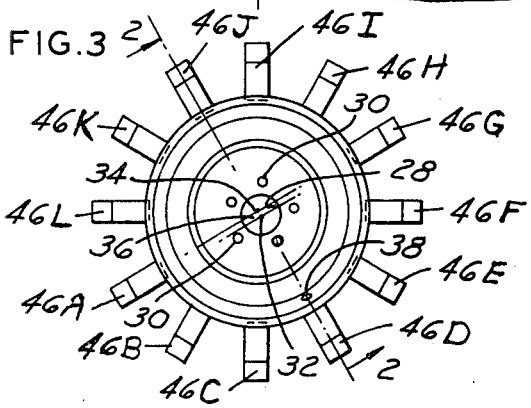
FIG. 3 is a schematic plan view of the tooling illustrated in FIG. 2 for fabrication of a wheel in accordance with the invention.

After the rim and disc have been assembled as described, the wheel 18 is placed in a die fixture 26 illustrated semi-schematically in FIGS. 2 and 3 for the purpose of forming the disc center pilot hole 28 and bolt holes 30. In accordance with the invention, the axial center line 32 of the center and/or bolt holes (preferably both) which pilot wheel 12 onto its vehicle mounting structure is eccentrically offset from the average centerline 34 of rim bead seats 20,22 by an amount 36 and in a direction empirically calculated to place the low point of the first harmonic of bead-seat radial run out adjacent a preselected location on the tire rim. Preferably, such low point is located substantially within the quadrant which includes the rim valve hole 38, i.e. within the range of about 45° on either side of the valve hole which provides a convenient point of reference on the wheel.

The foregoing is accomplished by placing wheel 12 into die 26 such that the central portion of disc 24 rests upon the die block 44. A plurality of radially reciprocable jaws 46 (FIG. 3), preferably twelve 46A-46L, are then closed against rim 18 until upper and lower contacts 48,50 on each jaw 46 engage respective bead seats 20,22. Preferably, wheel 12 is positioned such that valve hole 38 is located on a preselected jaw, i.e., jaw 46D in FIG. 3. Jaws 46A-46L thus firmly clamp wheel 12 to define bead seat average centerline 34. A punch assembly 52 having a central axis 32, a circular array of punches 54 for piercing and forming bolt holes 30 (FIGS. 1 and 3) and a center punch 56 for piercing and forming center pilot hole 28 is then lowered against the central portion of disc 24 to pierce and form the bolt and center holes.

To demonstrate operation of the invention, a wheel 12 was placed in die 26 and the jaws 46A-46L were individually adjusted from a nominal diameter of fourteen inches (for a fourteen-inch wheel) to positions indicated in the following table:

TABLE I

| | 46A | 46B | 46C | 46D | 46E | 46F | 46G | 46H | 46I | 46J | 46K | 46L |
|---|---|---|---|---|---|---|---|---|---|---|---|---|
| Contact 48 | 0 | 0 | −8 | −8 | −8 | 0 | 0 | 0 | +8 | +8 | +8 | 0 |
| Contact 50 | 0 | 0 | −8 | −8 | −8 | 0 | 0 | 0 | +8 | +8 | +8 | 0 |

wherein the numerals indicate displacement in thousandths of an inch of the respective contacts for each jaw, (−) toward the wheel center and (+) away from wheel center.

Note in particular in the above-described preferred mode of practicing the invention that opposed groups of one or more clamping jaws are offset with respect to the centerline of punch tooling 44,52 symmetrically of the valve hole. It is possible to accomplish this result on conventional wheel forming apparatus by radially shifting the axes of punch 52 and die 44. However, the clamping jaws are normally individually adjustable in commercially available wheel punching apparatus, while alignment between upper and lower punch tooling 52,44 is much more critical. Hence, it is preferred first to center all jaws on the axis of punch 52 and then physically shift the clamping position of approved groups of one or more jaws—i.e., jaws 46C-46E and 46I-46K—radially of the punch axis.

In two hundred wheels so manufactured, the average radial first harmonic measured from the axis of center pilot hole 28 was 0.014 inches with a standard deviation of 0.003 inches. The preferred range for this measurement is 0.005 to 0.020 inches. In 95% of the wheels, the low point of the first harmonic fell within an angular range of 60°. In 100% of the wheels, the low point fell within an 85° range between 350° and 75°, the valve hole being taken as 0°, all angles being measured counterclockwise of the wheel in the orientation of FIG. 3. Average eccentricity between the bolt and pilot holes axes was 0.005 inches.

The foregoing demonstrates the principle of the invention which, although increasing average radial run out and the value of the first harmonic above levels that would otherwise be desirable, locates the harmonic low point adjacent a preselected point in the wheel rim, preferably the valve hole. When tire 10 is mounted thereon with high point mark 14 adjacent valve hole 38, the respective harmonics cancel each other in whole or in part. Manifestly, the high point of the radial run out first harmonic could as easily be located adjacent the valve hole, or at any other desired location on the wheel. Instead of using the valve hole as the visually identifiable locator for the predetermined harmonic low or high point, it is also feasible to mark the wheel rim in the hole-forming operation with suitable indicia to identify the center of the angular zone in which the harmonic low or high point is placed by the aforementioned pierce and coin tooling set up. In this connection, it will be appreciated that hole "forming" must be read in the broad sense as encompassing piercing and equivalent operations for providing the openings, including after-piercing operations such as forming or coining for finishing the openings.

The invention claimed is:

1. In an apparatus for forming mounting openings in a disc vehicle wheel having a rim with bead seats and a disc, said apparatus comprising a circumferential series of clamping jaws for clamping said bead seats and means reciprocable on a first axis for forming disc openings in a wheel clamped by said jaws, the improvement wherein said jaws are disposed in radially opposed pairs with at least one of said pairs being centered in the wheel-clamping position of said jaws on a second axis offset from said first axis so as to clamp the wheel eccentrically with respect to said first axis such that openings formed in said wheel disc by said reciprocable means are eccentrically offset with respect to said wheel rim.

2. A method of forming mounting openings in a disc vehicle wheel having a rim with a tire bead seat region and a wheel mounting disc mounted internally of said rim, said method comprising the steps of locating said wheel on a predefined first axis by clamping said bead seat region coaxially with said first axis and then forming mounting openings in said disc on a second axis offset by a prespecified distance from said first axis such that said mounting openings formed in said wheel disc are eccentrically offset by said prespecified distance from said bead seat region.

3. A method of manufacturing a vehicle wheel comprising the steps of providing a wheel rim having a tire bead seat region extending circumferentially around said rim and a wheel mounting disc carried internally of said rim, and then forming wheel mounting openings is said disc by clamping said rim bead seat region so as to locate said bead seat region on a predefined first axis and then forming said mounting openings in said disc on a second axis radially offset from said first axis such that said mounting openings are eccentrically offset from said bead seat region by an amount and in a direction so as to locate a peak of the first harmonic of radial runout of said wheel circumferentially adjacent a selected location on said wheel rim.

4. The method set forth in claim 2 or 3 wherein said mounting openings comprise a center opening adapted to be received over a wheel hub and a circumferential array of openings surrounding said center openings and adapted to be received over wheel mounting bolts, said center openings and said circumferential array of bolt openings being centered on said second axis.

* * * * *